US005979727A

United States Patent [19]

Steurer

[11] Patent Number: 5,979,727

[45] Date of Patent: Nov. 9, 1999

[54] METHOD OF ATTACHING A REPLACEMENT DUAL LOOP SHOULDER STRAP TO A CONVENTIONAL SINGLE SHOULDER STRAP GOLF BAG

[76] Inventor: Steven T. Steurer, 18 Sterling Rd., Louisville, Ky. 40220

[21] Appl. No.: 09/035,659

[22] Filed: Mar. 6, 1998

[51] Int. Cl.[6] ..... A45F 3/14

[52] U.S. Cl. ..... 224/645; 224/257; 224/259; 224/627; 224/650; 224/651

[58] Field of Search ..... 224/600, 607, 224/613, 616, 627, 645, 651, 257, 259, 260; 206/315.3

[56] References Cited

U.S. PATENT DOCUMENTS

| | | | |
|---|---|---|---|
| D. 362,752 | 10/1995 | Steurer | D3/255 |
| 1,879,480 | 9/1932 | Pures | 224/260 |
| 4,911,347 | 3/1990 | Wilhite | 224/257 |
| 5,735,398 | 4/1998 | Price | 206/315.3 |

*Primary Examiner*—Gregory M. Vidovich
*Assistant Examiner*—Maerena W. Brevard

[57] ABSTRACT

The present invention comprises a dual loop shoulder strap (10) for carrying a golf bag (14) having a first loop (30) and a second loop (34). The first loop (30) is attached to a first connection point (32) on the golf bag (14) whereby an individual (12) inserts one arm through the first loop (30) to support the golf bag (14) on one shoulder (26). A second loop (34) is attached to a second connection point (35) on the golf bag (14) longitudinally spaced from the first connection point (32) whereby the individual (12) inserts another arm through the second loop (34) to support the golf bag (14) on another shoulder (28). The present invention is envisioned for use with a conventional type golf bag (14) having a tubular receptacle and a single shoulder strap (70) with two longitudinally spaced connection points (32) (35) therein, typically the connection points for connecting each end of the single shoulder strap (70). Each end of a first loop (30) is attached to one connection point (32) on the golf bag (14) and each end of the second loop (34) is attached to a second point (35) on the golf bag (14). The connection points are stationary relative to the receptacle.

4 Claims, 4 Drawing Sheets

METHOD OF ATTACHING A REPLACEMENT DUAL LOOP SHOULDER STRAP TO A CONVENTIONAL SINGLE SHOULDER STRAP GOLF BAG

BACKGROUND—TECHNICAL FIELD OF INVENTION

The present invention relates generally to golf equipment and in particular, to the method used to attach a replacement dual loop shoulder strap to what is known in the art as a conventional single shoulder strap golf bag. Frequently, golfers carry their own golf bags either to save the expense of a caddy or a cart, or because neither is available. Single strap golf bags are carried with great difficulty due to imbalance and excessive weight on one shoulder. The present invention is directed to solving these problems.

BACKGROUND—DESCRIPTION OF PRIOR ART

It is generally known in the sport of golf to carry a golf bag loaded with golf clubs and related golf equipment by means of a single shoulder strap. Said strap is typically attached at one end to a built in and permanently secured connection point adjacent the top or open end of the bag and at the other end to a built in and permanently secured connection point toward the center point of the bag. The two connection points are designed into the golf bag by the manufacturer to balance and hold the stress of the load being carried. The strap is typically supported on either shoulder of a carrier as the individual maneuvers about the golf course.

Conventional single shoulder strap golf bags are supported on only one shoulder at a time and the significant weight associated with golf equipment and the task of lugging a loaded golf bag during a game of golf (over the course a golfer may walk many miles) can be oppressively uncomfortable. Not only does the static weight of golf equipment bear painfully on the shoulders of the golfer, but also a golf bag has a tendency to bounce and shift as a golfer traverse the hills and rolling fairways found on golf courses. The tendency of a golf bag to slip not only intensifies the pain of supporting the loaded golf bag but, in addition, demands that the golfer expend energy merely to control the balance and the orientation of the bag to prevent the contents of the golf bag from spilling.

Therefore, inventors have created several types of dual strap carrying devices that attempt to overcome these problems. Nevertheless the following examples will not easily and cost effectively replace the golf bags single shoulder strap by connecting to only the built in attachment points, designed into the golf bag by the manufacturer to handle the stress of the heavy golf equipment, and in manner with a symmetrical configuration that creates perfect 50/50-weight distribution. The following examples suffer disadvantages.

U.S. Pat. No. 2,853,111 issued to Anna K. Williams, U.S. Pat. No. Des 362,752 issued to Steven T. Steurer and U.S. Pat. No. 5,636,778 issued to George H. Jones all illustrate a dual carry straps that are only directed to newly manufactured golf bags wherein the straps are integral parts of the bag. And are attached to non-conventional spaced connection points. These examples cannot be used as a replacement strap for an existing golf bag.

U.S. Pat. No. 4,487,347 issued to Michael A. Zegar illustrates a dual strap that converts a single strap golf bag to a dual strap arrangement. This arrangement uses a rigid bar with two straps attached to convert a single strap golf bag to the dual strap arrangement. This bar is responsible for a number of disadvantages: For comfort a carry type golf bag should be as light weight as possible, this rigid bar adds unneeded an excessive weight. The unneeded rigid bar adds additional cost which is a disadvantage in the mass production of this arrangement. Conventional golf bags are mass-produced in a multitude of sizes. Which would make this rigid bar impossible to be produced in only one size. Therefore many bar sizes would have to be produced adding extra cost and confusion for the manufacturer and the end user. The needed multiple size rigid bar does not lend itself to the mass production and easy retail distribution of this arrangement. A carry type golf bag is typically soft sided and conforms to the carriers back. The added unneeded rigid bar is stiff and will cause discomfort as it rides against the carriers back.

U.S. Pat. Nos. 5,038,984, 5,042,703, 5,042,704 issued to Theodore-James Izzo illustrates a dual strap attached to typically non standard means of attachment, and is better directed to newly manufactured golf bags and has a number of disadvantages. The top and bottom ends of the straps are connected to typically non-standard slideable means of attachment. Therefore the strap that is shown will not replace the strap on a conventional single strap golf bag. The typical single strap golf bag would need many alterations and structural design changes for this dual strap to easily retrofit. The center pivot point of this strap is attached to the handle of the conventional golf bag, the added weight would damage the handle during use. The typical handle on the conventional golf bag is not designed to support the continuous stress of the heavy gear being carried. Attachment to the handle allows the non-permanent center pivot point to shift up and down on the handle which negatively effects the center of gravity and the balance of the load being carried.

U.S. Pat. No. 5,348,205 issued to Steven T. Steurer discloses a dual loop carry device which attaches both loops to a golf bags handle and teaches away from attachment to the permanently secured connection points that are designed to control the balance and hold the weight being carried. This arrangement would cause undue stress to be placed on the handle and damage the bag. And attachment of both loops to the handle places the connection points too close together which causes poor balance and makes the loaded golf bag hard to control.

U.S. Pat. No. 5,429,288 issued to Warren A. Sattler and U.S. Pat. Nos. 5,558,259, 5,593,077 issued to Theodore-James Izzo disclose dual strap arrangements that use some type of longitudinally spaced first strap and adds a second strap to support the golf bag partially on the other shoulder of the carrier. In these arrangements the two straps are not the same size and do not allow for perfect balance and weight distribution. The longer longitudinally spaced first strap typically carries more weight.

OBJECTS AND ADVANTAGES

A need exist, therefore, for a dual loop shoulder strap which will easily and cost effectively replace the single shoulder strap of a conventional golf bag and provide perfect balance and weight distribution.

The present invention is directed toward overcoming all of the problems set forth above. The advantages of the present invention are. It allows for the easy replacement of any single shoulder strap. Provides for the perfect balance and control of the load being carried. Distributes the weight of the golf bag evenly over both shoulders. Easily converts a single shoulder strap golf bag by simply removing the single strap and replacing it at the same connection points.

Attaches to only the connection points designed by the manufacturer to bear the weight of the heavy golf equipment, the present invention will not damage the golf bag like other dual carry straps that connect to the handle of the golf bag. Retrofits existing single shoulder strap golf bags as well as allows manufacturers to cost effectively add onto a golf bag at the time of manufacturer. The universal design works on any golf bag, regardless of size.

SUMMARY OF THE INVENTION

In accordance with the present invention, a dual loop shoulder strap for carrying a golf bag which replaces the single shoulder strap of any conventional single shoulder strap golf bag. The present invention has two twin loops, a first loop and a second loop. The first loop is attached to a first connection point on the bag provided by the manufacturer to hold one end of the single shoulder strap whereby an individual inserts one arm through the first loop to support the golf bag on one shoulder. A second loop is attached to a second connection point on the bag provided by the manufacturer to hold the opposite end of said single strap spaced from the first connection point whereby the individual inserts another arm through the second loop to support the golf bag on another shoulder.

The first loop consists of a first elongated belt having mutually opposed belt ends. Both of the first belt ends are connected to one of the longitudinally spaced connection points. The second loop consists of a second elongated belt having mutually opposed belt ends. Both of the second belt ends are connected to the other of the longitudinally spaced connection points. Preferably, the length of each end of both belts can be varied for adjusting the size of the loops defined thereby.

The present invention is envisioned for use with any conventional single shoulder strap golf bag having a tubular receptacle and a single shoulder strap with two connection points therein, specifically the connection points used for connecting each end of the single shoulder strap. Each end of a first loop is attached to one of the built in connection points on the bag and each end of a second loop is attached to the second built in point on the bag. The connection points are stationary relative to the receptacle.

The present invention as described provides a "twin loop" design, which symmetrically distributes the weight of the golf bag evenly over both shoulders, and attaches to the connection points designed to hold the stress of the load being carried.

BRIEF DESCRIPTIONS OF THE DRAWINGS

The features of this invention which are believed to be novel are set forth with particularity in the appended claims. The invention together with its objects and advantages, may be understood from the following description taken in conjunction with the accompanying drawings, in which like reference numerals identify like elements in the figures and in which:

DESCRIPTION OF PREFERRED EMBODIMENT

The present invention, as mentioned, basically embodies a conventional single shoulder strap golf bag and a dual loop-carrying device. The single shoulder strap golf bag has two attachment points thereon, specifically the built in and permanently secured longitudinally spaced attachment points for each end of the single shoulder strap.

The present invention, when used in conjunction with a conventional single shoulder strap golf bag, broadly includes a pair of twin loops, both ends of each is capable of being attached to one of the said opposing single shoulder strap attachment points, replacing the single shoulder strap.

Figure 1:
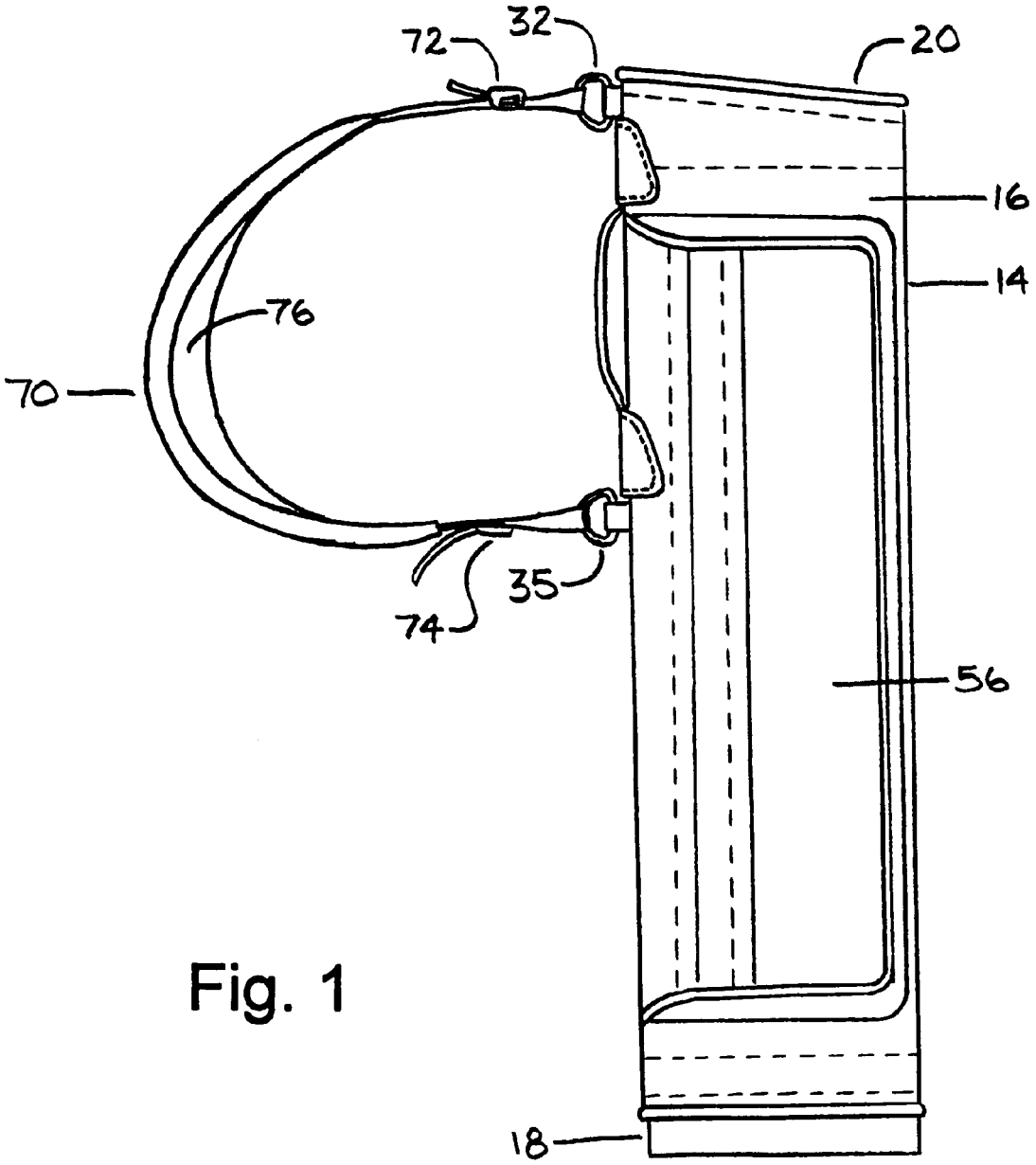
FIG. 1 is a side view of a conventional single shoulder strap golf bag.

The embodiments of this invention may be seen with respect to the figures. FIG. 1 is a view illustrating a golf bag prior to replacing the single shoulder strap 70 with the present invention dual shoulder strap 10. Generally golf bags are manufactured with a longitudinally attached open loop single shoulder strap 70 with one end attached to a connection point 32 adjacent to the top or open end of the golf bag 14 and at the other end attached to a connection point 35 toward the center of the golf bag 14. Preferably, both ends of the single shoulder strap 70 are each detachably connectable to the golf bag 14 any number of types of detachable attachment means may be utilized as one of the skill will recognize. The illustrated embodiment in FIG. 1 is a golf bag in which the single shoulder strap has not been replaced by the present invention so as to illustrate how the present invention and the single shoulder strap 70 use the same built in and permanently secured longitudinally spaced connection points 32 and 35. FIG. 1 also shows the illustration of the typical single shoulder strap 70 and its fastening means 72 and 74 attached to the same connection points 32 and 35 as used by the present invention in FIG. 2. Generally the single shoulder strap 70 includes a central padded section 76 an upper fastening means 72 and a lower Fastening means 74. The upper and lower fastening means 72 and 74 provide for the detachable connection of the single shoulder strap 70. Said detachable connections allow for the present invention to replace the single shoulder strap 70.

Figure 2:
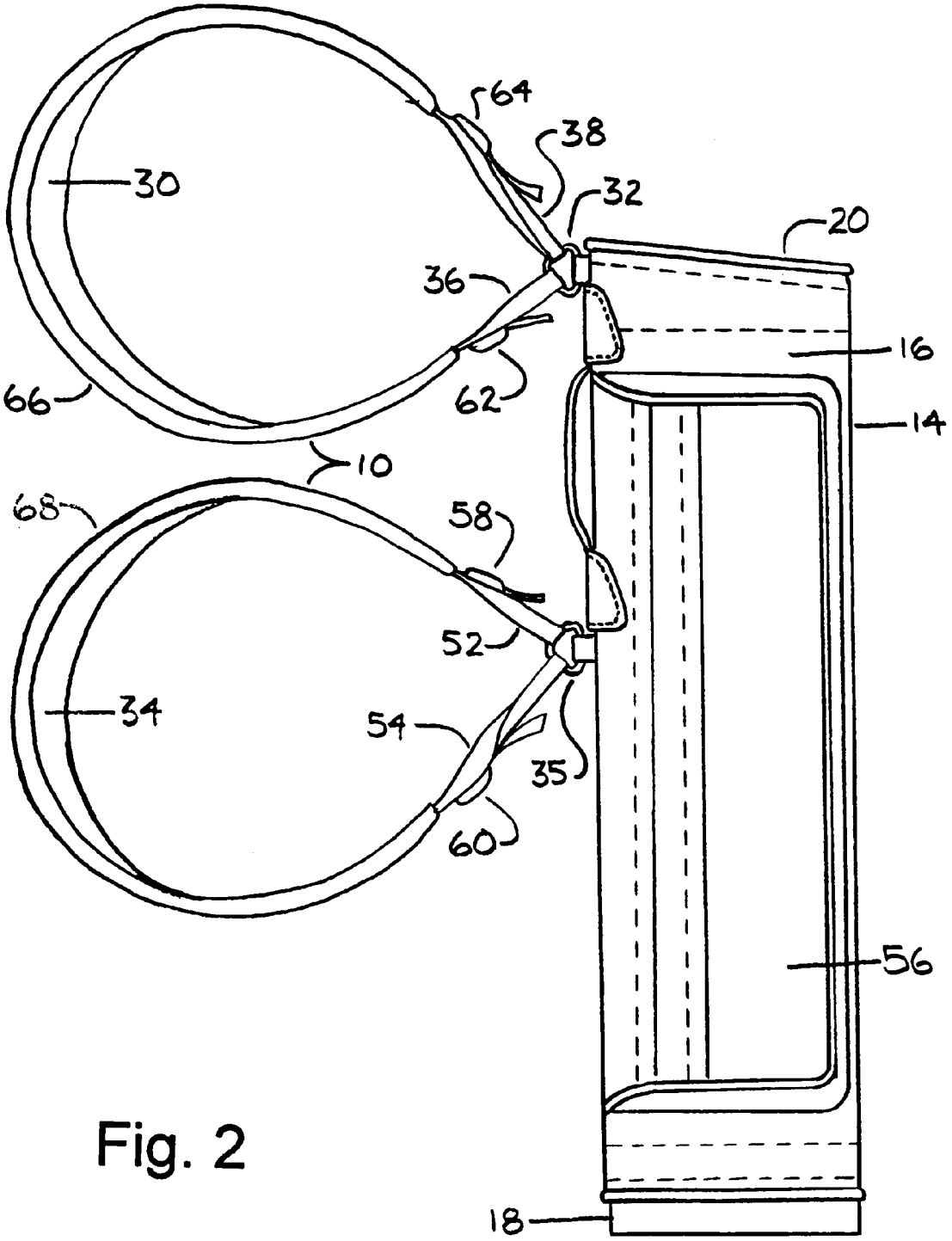
FIG. 2 is a side view of the golf bag in FIG. 1 with the single strap removed and replaced with the present invention.

The golf bag structure implementing the present invention is shown in greater detail in FIG. 2. In this figure the single strap is removed and replaced by dual loops. It may be seen that golf bag 14 has a first strap defined by an upper primary strap 30 and has a first end 38 which is secured to golf bag 14 at a first location 32 along an upper end portion adjacent to the open end 20. A second lower end 36 of the strap 30 is secured to the golf bag 14 at the same location 32. The lower strap 34 ends 52 and 54 are secured to the bag 14 at a second location 35 longitudinally spaced from the point of the top attachment 32 of ends 36 and 38 and toward a lower portion of golf bag 14.

Figure 3:
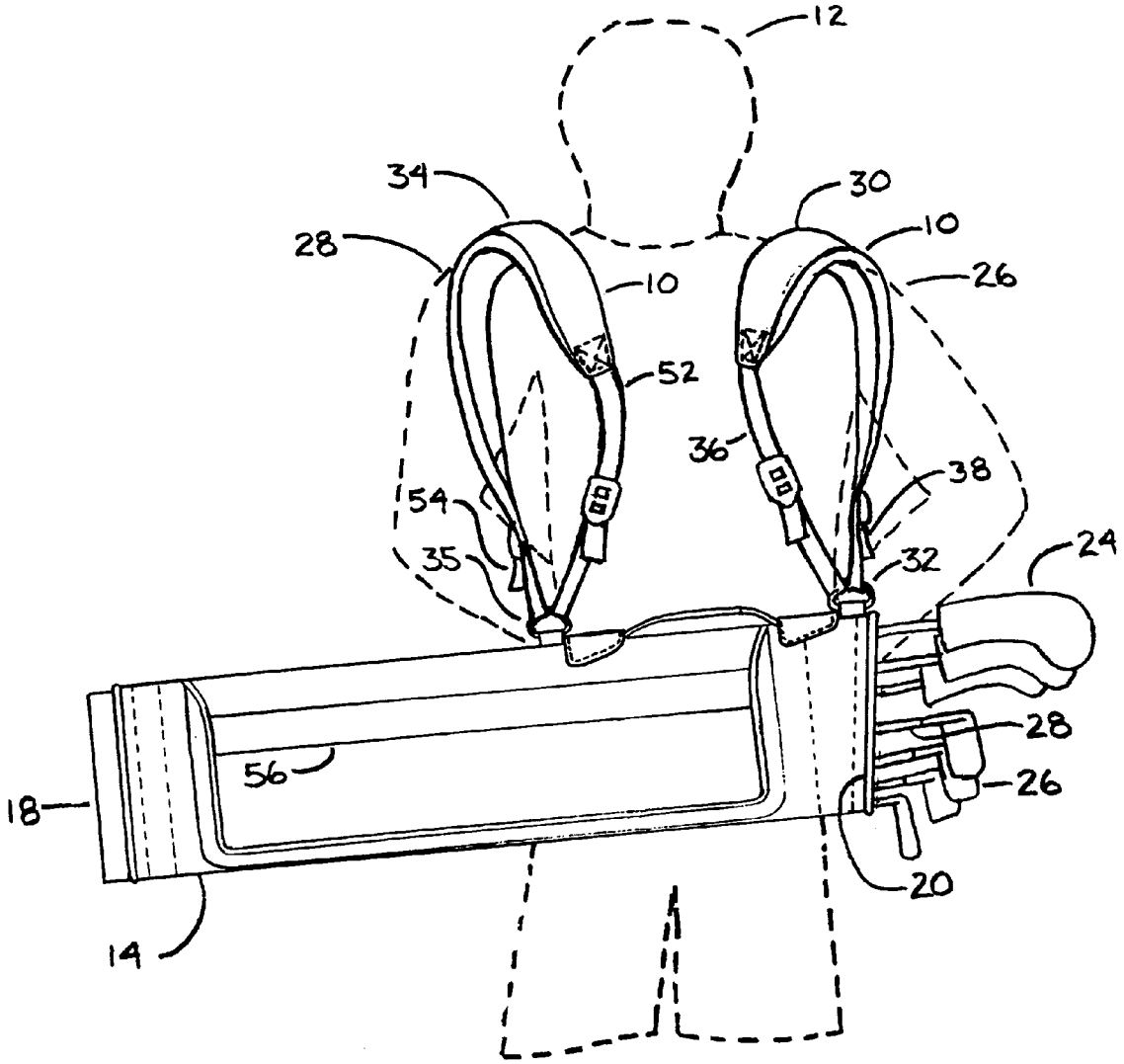
FIG. 3 is a perspective rear view of a person carrying a golf bag utilizing the present invention.

Thus, as shown in FIG. 3, the loops 30 and 34 are defined by elongated belts having mutually opposed belt ends 36,38, 52 and 54. A widened load distributing central portion 66 and 68 of belts 30 and 34 preferably include a foam pad or other cushion material suitable for reducing discomfort when the loops 30 and 34 bear against the shoulders 26 and 28 of an individual 12 carrying the golf bag 14. Slotted buckles 58,60,62 and 64 are fastened to the straps 36,38,52 and 54 for attachment and adjustment.

In FIG. 3, for illustration purposes, a golf bag 14 is carried in a fully supported state by a first strap 30 and a second strap 34. The golf bag 14 is in the form of an elongated enclosure or tubular body having a surrounding sidewall 16, a closed end 18 and an open end 20 so that a set of golf clubs 24 includes a head, such as head 26 and a shaft such as shaft 28. Auxiliary compartments 50 and 56 are provided to permit transport of auxiliary golf equipment and are oriented to counterbalance the weight of the golf bag and clubs.

Figure 4:
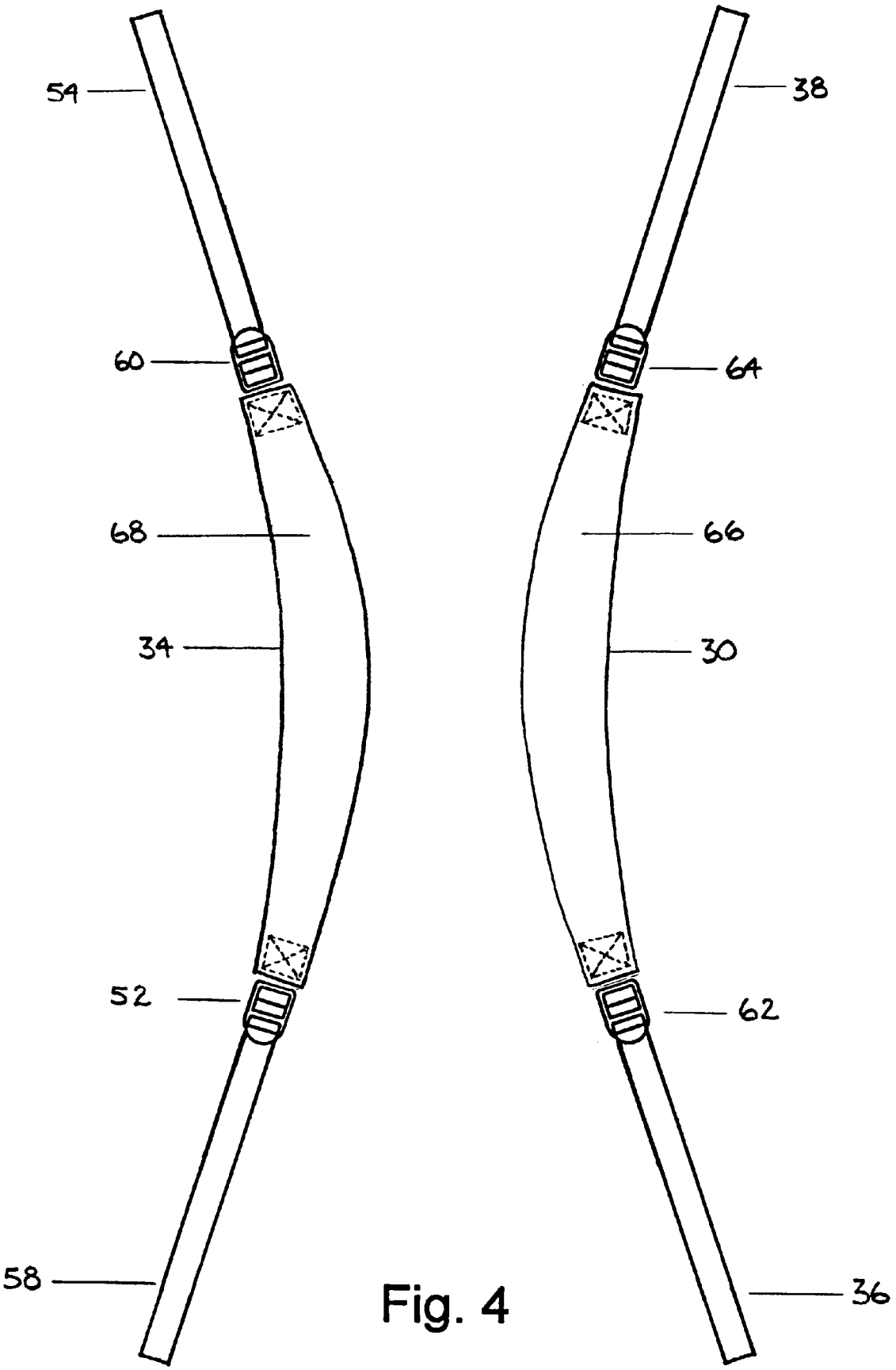
FIG. 4 is a top plan view illustrating the strap member when disconnected from the bag and in a flattened condition.

Illustrated in FIG. 4, the shoulder straps 30 and 34 when laid out in a flattened condition unattached from the bag will have a curvilinear configuration which has been found to better conform to the shoulders 26 and 28 when attached to the bag 14 and placed in carrying position as previously described. The curvilinear shoulder straps 30 and 34 will when placed on the shoulders 26 and 28 lay flat against the shoulders and relatively near the neck so as not to tend to slip off. Moreover, the lower ends of the straps 36,38,52 and 54 will tend to lay flush against the sides of the carrier 12 beneath the armpits and minimize any tendency to slide along or chafe the body of the carrier 12.

SUMMARY, RAMIFICATION AND SCOPE

Accordingly, the reader will see that the dual loop carrying device of the present invention is an easily adaptable, cost effective way to convert any readily available single strap golf bag to an easy to carry perfectly balanced dual strap arrangement.

In addition, the present invention, golf bag dual strap-carrying device, solves the problems inherent in single strap golf bags and other dual strap carrying devices. It allows the golfer to easily "convert" any conventional single shoulder strap golf bag to a dual strap bag without alterations, structural changes, manufacturer design chances, unneeded extra parts or the need of the user to purchase an entirely new golf bag. It should be therefore understood that while the preferred form of the present invention have been herein set forth and described, various other modifications and changes may be made without departing from the spirit and scope of the invention as defined by the appended claims and reasonable equivalents thereof.

I claim:

1. An improved method of replacing the shoulder strap of a conventional single shoulder strap golf bag comprising a golf bag having an elongated enclosure, a closed end and an opposite open end for receiving golf equipment, a detachably mounted single shoulder strap of single open loop configuration extending in a generally longitudinal direction between two permanently secured spaced connection points along the outer surface of said enclosure, the first of said connection points disposed adjacent to said open end and the other of said connection points longitudinally spaced from said first connection point, whereby said golf bag is carried by passing said single strap over one shoulder of an individual, the method comprising:

providing a first strap having mutually opposing strap ends with respective fastening means for fastening to one of said connection points;

connecting each said fastening means of said first strap to said first connection point on said golf bag, forming a first carrying loop which is adapted to be carried on one shoulder of an individual for supporting the golf bag thereon;

providing a second strap having mutually opposing strap ends respective with fastening means for fastening to one of said connection points;

connecting each said fastening means of said second strap to said connection point on said golf bag, forming a second carrying loop which is adapted to be carried on another shoulder of an individual for supporting the golf bag thereon.

2. The method of claim 1 wherein said fastening means adjust the length of each strap end.

3. An improved method of replacing a shoulder strap of a conventional single shoulder strap golf bag comprising a golf bag having a tubular receptacle with a closed end and an open upper end for receiving golf equipment, the receptacle having a single shoulder strap removably attached to two permanently secured connection points longitudinally spaced between the receptacle ends, the connection points typically used to attach a single shoulder strap, the method comprising:

providing a first elongated belt having mutually opposed belt ends and fastening buckles attached to each said belt end, fastening each of the belt ends directly to said first connection point on the receptacle, whereby the first belt defines a first loop;

providing a second elongated belt having mutually opposed belt ends and fastening buckles attached to each said belt end of said second belt; fastening each of the belt ends of said second belt directly to said second connection point on the receptacle, whereby the second belt defines a second loop on the receptacle.

4. The method in claim 3 in which both ends of each said belts are each adjustable in length by means of the said fastening buckles.

* * * * *